US007444839B2

(12) United States Patent
Pinelli

(10) Patent No.: US 7,444,839 B2
(45) Date of Patent: Nov. 4, 2008

(54) THERAPEUTIC HOSIERY ITEM AND METHOD FOR MANUFACTURING THE SAME WITH A CIRCULAR HOSIERY KNITTING MACHINE

(75) Inventor: Enzo Pinelli, Castel Goffredo (IT)

(73) Assignee: Calzificio Pinelli S.R.L., Castel Goffredo (IT)

( * ) Notice: Subject to any disclaimer, the term of this patent is extended or adjusted under 35 U.S.C. 154(b) by 152 days.

(21) Appl. No.: 10/556,506

(22) PCT Filed: May 27, 2004

(86) PCT No.: PCT/EP2004/005715

§ 371 (c)(1),
(2), (4) Date: Nov. 14, 2005

(87) PCT Pub. No.: WO2004/106607

PCT Pub. Date: Dec. 9, 2004

(65) Prior Publication Data

US 2006/0196231 A1 Sep. 7, 2006

(30) Foreign Application Priority Data

May 29, 2003 (IT) ..... MI2003A1082

(51) Int. Cl.
*D04B 1/26* (2006.01)

(52) U.S. Cl. ..... 66/178 A

(58) Field of Classification Search ..... 66/178 R, 66/182–188, 178 A
See application file for complete search history.

(56) References Cited

U.S. PATENT DOCUMENTS

| | | | | |
|---|---|---|---|---|
| 2,574,737 | A | 11/1951 | Goodchild | |
| 2,720,097 | A | 10/1955 | De Mond | |
| 2,962,885 | A | 12/1960 | Knohl | |
| 4,180,869 | A * | 1/1980 | Pedergrass et al. | 2/240 |
| 5,335,517 | A * | 8/1994 | Throneburg et al. | 66/185 |
| 5,412,957 | A * | 5/1995 | Bradberry et al. | 66/178 A |
| 6,725,691 | B2 * | 4/2004 | Yakopson | 66/178 A |

FOREIGN PATENT DOCUMENTS

| | | |
|---|---|---|
| GB | 983 719 A | 2/1965 |
| GB | 1 126 426 A | 9/1968 |

* cited by examiner

*Primary Examiner*—Danny Worrell
(74) *Attorney, Agent, or Firm*—Modiano & Associati; Albert Josif; Daniel J. O'Byrne

(57) ABSTRACT

A therapeutic hosiery item and a method for manufacturing the same with a circular hosiery knitting machine. The therapeutic hosiery item comprises first rows of knitting alternated with second rows of knitting produced with a number of stitches that is smaller than the number of stitches constituting the first rows of knitting. The first rows of knitting are composed of at least one stretch yarn and the second rows of knitting are composed of at least one stretch yarn that has a larger diameter than the at least one stretch yarn that composes the first rows of knitting.

32 Claims, No Drawings

THERAPEUTIC HOSIERY ITEM AND METHOD FOR MANUFACTURING THE SAME WITH A CIRCULAR HOSIERY KNITTING MACHINE

TECHNICAL FIELD

The present invention relates to a therapeutic hosiery item and to a method for manufacturing the same with a circular hosiery knitting machine.

BACKGROUND ART

As is known, therapeutic hosiery items are special hosiery items conceived and structured so as to apply a dosed and optionally localized containment action in order to provide therapeutic effects on the lower limbs of the user.

For this reason, these hosiery items are mainly produced by using stretch yarns that are optionally pretensioned, with knitting processes aimed at achieving the intended therapeutic effect and with minimal concern for the aesthetic effect. Currently commercially available therapeutic hosiery items are generally produced with circular hosiery knitting machines using 1:1 knitting alternated with the formation of laid-in knitting.

This particular production method causes therapeutic hosiery items, particularly in the case of women's stockings, to be aesthetically very different from other kinds of hosiery item.

For this reason, currently commercially available therapeutic hosiery items generally are not seen favorably by users, particularly female users, since they are not able to achieve the elegance and softness of other hosiery item types.

Furthermore, the particular manufacturing method of currently commercially available therapeutic hosiery items requires, in order to produce the heel and/or toe regions, alternating rotary actuation of the needle cylinder about its axis, with relatively long production times and accordingly with relatively high production costs.

DISCLOSURE OF THE INVENTION

The aim of the present invention is to solve the problem described above by providing a therapeutic hosiery item manufactured so that it has a styling that is comparable with that of elegant hosiery items.

Within this aim, an object of the invention is to provide a therapeutic hosiery item that while having an excellent aesthetic effect still fully provides its therapeutic functions.

Another object of the invention is to provide a therapeutic hosiery item that can be manufactured at competitive costs.

Another object of the invention is to provide a method for manufacturing a therapeutic hosiery item according to the invention with a circular hosiery knitting machine.

This aim and these and other objects that will become better apparent hereinafter are achieved by a therapeutic hosiery item, characterized in that it comprises first rows of knitting alternated with second rows of knitting produced with a number of stitches that is smaller than the number of stitches constituting said first rows of knitting, said first rows of knitting being composed of at least one stretch yarn and said second rows of knitting being composed of at least one stretch yarn that has a larger diameter than said at least one stretch yarn of said first rows of knitting.

The therapeutic hosiery item according to the invention is preferably produced by means of a method for manufacturing therapeutic hosiery items with a circular hosiery knitting machine, characterized in that it consists in alternating first rows of knitting with second rows of knitting formed with a number of stitches that is smaller than the number of stitches constituting said first rows of knitting, said first rows of knitting being produced by means of at least one stretch yarn and said second rows of knitting being produced by means of at least one stretch yarn that has a larger diameter than the at least one yarn used to produce said first rows of knitting.

BRIEF DESCRIPTION OF THE DRAWING

Further characteristics and advantages of the invention will become better apparent from the description of a preferred but not exclusive embodiment of the therapeutic hosiery item according to the invention and of the method for manufacturing the same, illustrated by way of non-limiting example in the accompanying drawings, wherein the only FIGURE is a schematic enlarged-scale view of a tensioned portion of the therapeutic hosiery item according to the invention.

WAYS OF CARRYING OUT THE INVENTION

With reference to the FIGURE, the therapeutic hosiery item according to the invention comprises first rows of knitting 1, which are alternated with second rows of knitting 2, which are produced with a number of stitches that is smaller than the number of stitches constituting the first rows of knitting 1. The first rows of knitting 1 are composed of at least one stretch yarn 1*a* and the second rows of knitting 2 are composed of at least one stretch yarn 2*a* that has a larger diameter, or rather a larger count or Denier, with respect to the diameter or count of the at least one stretch yarn 1*a* of the first rows of knitting 1.

Conveniently, the stitches of the second rows of knitting 2, which are less numerous than the stitches of the first rows of knitting 1, are mutually aligned so as to form rib knitting, as will become better apparent hereinafter.

The second rows of knitting 2 are composed of at least one yarn 2*a* made of coated elastomer (for example Elastane), preferably a double-coated elastomer yarn 2*a*.

More particularly, in the yarn 2*a*, the elastomer yarn has a count or Denier that is preferably comprised between 78 and 800 den, and the yarn or yarns used to coat it may be made of natural or polyamide fibers, with a count preferably comprised between 8 and 110 den.

The first rows of knitting 1 are composed of at least one coated elastomer yarn (for example Elastane), preferably a yarn 1*a* made of double-coated elastomer (for example Elastane), possibly plate-knitted with another or further yarn 1*b*. Said other yarn 1*b* is preferably constituted by a yarn made of polyamide fibers or natural fibers and has a count preferably comprised between 8 and 150 den.

More particularly, in the yarn 1*a*, the elastomer yarn has a count preferably comprised between 10 and 280 den and the yarn or yarns used to coat it may be of natural or polyamide fibers and has or have a count preferably comprised between 5 and 85 den.

The therapeutic hosiery item according to the invention may be provided in the form of a pop sock, hold-up stocking, conventional stocking to be worn with suspender-belts, or pantyhose, and the particular knitting described in detail above may be provided substantially along the entire hosiery item or limited to preset regions, depending on the requirements and on the type of therapeutic hosiery item.

In any case, the knitting described above allows to obtain therapeutic hosiery items that are aesthetically very similar to conventional elegant hosiery items.

The degree of compression on the leg of the user that can be obtained with the hosiery item according to the invention or which the hosiery item is adapted to provide is preferably comprised between 18 and 60 mm Hg.

The method for producing therapeutic hosiery items according to the invention substantially consists in alternating first rows of knitting 1 with second rows of knitting 2 provided with a number of stitches that is smaller than the number of stitches composing the first rows of knitting 1. The first rows of knitting 1 are provided by means of at least one stretch yarn 1*a* and the second rows of knitting 2 are provided by means of at least one stretch yarn 2*a* that has a larger diameter, or rather a larger count, than the diameter or count of the at least one yarn a used to produce the first rows of knitting 1.

The stitches of the second rows of knitting 2 are provided by means of the same needles for the various second rows of knitting 2, thus obtaining rib knitting.

In a multiple-feed circular machine, the first rows of knitting 1 can be formed at feeds or drops that are alternated, in the arrangement of the feeds or drops around the axis of the needle cylinder, with feeds or drops that are used to form the second rows of knitting 2.

In a circular hosiery knitting machine with four feeds or drops, the first rows of knitting 1 are formed by using the second drop and the fourth drop, while the second rows of knitting 2 are formed by using the first drop and the third drop, along the direction of rotation of the needle cylinder about its own axis. Obviously, the particular knitting of the therapeutic hosiery item according to the invention may also be obtained by using the first drop and the third drop to form the first rows of knitting and the second and fourth drops to form the second rows of knitting.

In the first case, the particular knitting for providing the therapeutic hosiery item-according to the invention is preferably performed by making all the needles of the needle cylinder of the machine form plain knitting at the second drop and at the fourth drop, while at the first drop and at the third drop only some of the needles of the needle cylinder of the machine, uniformly distributed along the circumferential extension of the needle cylinder according to a preset needle selection, for example a 1:1, 2:1, 3:1, 1:3, 1:2 selection, et cetera, are made to knit. In practice, the needle cylinder is ideally divided into sectors arranged sequentially around the needle cylinder axis, each sector containing two or more needles and moving into the active position, at the first drop and at the third drop, only some of the needles of the various groups, which are uniformly spaced around the axis of the needle cylinder, with a needle selection that is commonly known as 1:1, 2:1, 3:1, 1:3, 1:2, et cetera.

The needles that are not made to knit at the first and third drops pass, at said drops, with their beak below the knockover plane formed by the sinkers of the machine, and each needle retains the last loop of knitting formed at the previous drop, which is knitted in with a new loop of knitting formed at the drop that follows the one where the needle is moved to knit.

In practice, with particular reference to the knitting shown in the accompanying FIGURE, at least one stretch yarn, in the illustrated case a yarn 2*a* made of coated elastomer (for example Elastane), is dispensed at the first drop and at the third drop. At least one yarn, having a smaller diameter than the at least one yarn 2*a* dispensed at the first and third drops, is dispensed at the second and fourth drops. A yarn 1*a* made of coated elastomer (for example Elastane) is preferably dispensed at the second and fourth drops and is plate-knitted with another yarn 1*b*, which can be constituted by a yarn made of natural fibers or polyamide fibers.

It should be noted that the particular knitting by means of which the therapeutic hosiery item according to the invention is produced allows to provide the heel and/or toe regions of the hosiery item without necessarily resorting to knitting with actuation of the needle cylinder with an alternating rotary motion about its own axis.

Merely by way of non-limiting example, an example of practical execution of the method according to the invention on a circular hosiery knitting machine with four feeds is described hereinafter.

EXAMPLE

A coated Elastane yarn with a count of 280 denier is dispensed at the first drop and at the third drop. A yarn made of coated Elastane with a count of 22 denier, plate-knitted with a yarn of polyamide fibers or natural fibers, is dispensed at the second and fourth drops.

All the needles of the machine are made to knit at the second and fourth drops, forming drop stitches and producing plain knitting.

Half of the needles of the needle cylinder, with a needle selection of the 1:1 type, are moved to knit at the first and third drops. At the first and third drops, the needles that do not knit are kept low, with their beak below the knockover plane formed by the sinkers of the machine, retaining the loop of knitting formed with the yarn dispensed at the previous feed. At the second drop and at the fourth drop, said needles are made to knit, together with the other needles, and form a new loop of knitting with the yarns provided at said feeds. The new loops are knitted in with the previously formed loops, which are unloaded from the needles.

In practice it has been found that the therapeutic hosiery item according to the invention fully achieves the intended aim, since it allows to obtain, from the therapeutic standpoint, the same results as currently commercially available therapeutic hosiery items but with the advantage of being much better from an aesthetic standpoint, since it can be sheerer and more transparent, achieving aesthetic effects that can be compared with those of elegant hosiery items. The therapeutic hosiery item according to the invention can be used, therefore, without problems like an elegant hosiery item.

The therapeutic hosiery-item as well as the method for its production thus conceived are susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application no. MI2003A001082, from which this application claims priority, are incorporated herein by reference.

The invention claimed is:

1. A therapeutic hosiery item, comprising first rows of knitting alternated with second rows of knitting produced with a number of stitches that is smaller than the number of stitches constituting said first rows of knitting, said first rows of knitting being composed of at least one stretch yarn and said second rows of knitting being composed of at least one stretch yarn that has a larger diameter than said at least one stretch yarn of said first rows of knitting, said first rows of knitting being composed of at least one coated elastomer yarn that is plate-knitted with a further yarn, said first and second rows of knitting being provided substantially along the entire hosiery item.

2. The therapeutic hosiery item of claim 1, wherein the stitches of said second rows of knitting are mutually aligned, producing rib knitting.

3. The therapeutic hosiery item of claim 1, wherein said second rows of knitting are composed of at least one coated elastomer yarn.

4. The therapeutic hosiery item of claim 2, wherein said second rows of knitting are composed of a double-coated elastomer yarn.

5. The therapeutic hosiery item of claim 2, wherein said second rows of knitting have a count of the elastomer yarn that is substantially comprised between 78 and 800 den.

6. The therapeutic hosiery item of claim 3, wherein said elastomer yarn of said second rows of knitting has a count of the coating yarn or yarns that is substantially comprised between 8 and 110 den.

7. The therapeutic hosiery item of claim 3, wherein the yarn or yarns for coating said elastomer yarn of said second rows of knitting is made of natural or polyamide fibers.

8. The therapeutic hosiery item of claim 1, wherein said first rows of knitting are composed of at least one coated elastomer yarn.

9. The therapeutic hosiery item of claim 1, wherein said first rows of knitting are composed of a double-coated elastomer yarn.

10. The therapeutic hosiery item of claim 1, wherein said further yarn that composes said first rows of knitting is constituted by a yarn made of polyamide fibers or natural fibers.

11. The therapeutic hosiery item of claim 10, wherein said further yarn that composes said first rows of knitting has a count that is substantially comprised between 8 den and 150 den.

12. The therapeutic hosiery item of claim 10, wherein the elastomer yarn of said first rows of knitting has a count that is a substantially comprised between 10 and 280 den.

13. The therapeutic hosiery item of claim 10, wherein a thread or threads for coating said elastomer yarn of said first rows of knitting has a count that is substantially comprised between 5 and 85 den.

14. The therapeutic hosiery item of claim 10, wherein the coating yarn or yarns of said elastomer yarn of said first rows of knitting is or are made of natural or polyamide fibers.

15. The therapeutic hosiery item of claim 1, having a degree of compression on the leg of a user that is substantially comprised between 18 and 60 mm Hg.

16. A method for producing therapeutic hosiery items with a circular hosiery knitting machine, consisting in alternating first rows of knitting with second rows of knitting provided by means of a number of stitches that is smaller than the number of stitches composing said first rows of knitting, said first rows of knitting being provided by way of at least one stretch yarn and said second rows of knitting being provided by way of at least one stretch yarn that has a larger diameter than the at least one yarn used to provide said first rows of knitting, further comprising providing said first rows of knitting by way of at least one coated elastomer yarn plate-knitted with a further yarn, and providing said first and second rows of knitting substantially along the entire hosiery item.

17. The method of claim 16, comprising providing stitches of said second rows of knitting by way of the same needles in the various second rows, forming rib knitting.

18. The method of claim 16, comprising providing said second rows of knitting by way of at least one coated elastomer yarn.

19. The method of claim 16, comprising providing said second rows of knitting by way of a double-coated elastomer yarn.

20. The method of claim 18, wherein the elastomer yarn used to provide said second rows of knitting is provided with a count that is substantially comprised between 78 and 800 den.

21. The method of claim 18, wherein the coating yarn or yarns of the elastomer yarn used to provide said second rows of knitting is provided with a count that is substantially comprised between 8 and 110 den.

22. The method of claim 18, wherein the coating yarn or yarns of said elastomer yarn used to provide said second rows of knitting is made of natural or polyamide fibers.

23. The method of claim 16, comprising providing said first rows of knitting by way of at least one coated elastomer yarn.

24. The method of claim 16, comprising providing said first rows of knitting by way of a double-coated elastomer yarn.

25. The method of claim 16, comprising making a further yarn used to form said first rows of knitting with a yarn made of polyamide fibers or natural fibers.

26. The method of claim 25, wherein said further yarn used in the formation of said first rows of knitting is provided with a count that is substantially comprised between 8 den and 150 den.

27. The method of claim 25, wherein the elastomer thread used to provide said first rows of knitting is provided with a count that is substantially comprised between 10 and 280 den.

28. The method of claim 25, wherein the yarn or yarns for coating said elastomer yarn used to provide said first rows of knitting is provided with a count that is substantially comprised between 5 and 85 den.

29. The method of claim 28, wherein the coating yarn or yarns of said elastomer yarn used to provide said first rows of knitting is made of polyamide or natural fibers.

30. The method of claim 16, comprising providing a machine for producing therapeutic hosiery items that is a circular hosiery knitting machine with multiple feeds, said first rows of knitting being formed at feeds or drops that are alternated, in the arrangement of the feeds or drops around the axis of the needle cylinder, with feeds or drops that are used to form said second rows of knitting.

31. The method of claim 16, comprising providing a machine for producing therapeutic hosiery items that is a circular hosiery knitting machine with four feeds or drops, said first rows of knitting being formed by using the second drop and the fourth drop, said second rows of knitting being formed by using the first drop and the third drop, or vice versa, depending on the direction of rotation of the needle cylinder about its own axis.

32. The method of claim 31, wherein all the needles of the needle cylinder of the machine are made to knit at said second drop and at said fourth drop and only part of the needles of the needle cylinder of the machine, uniformly distributed along the circumferential extension of the needle cylinder according to a preset needle selection, are moved to knit at said first drop and said third drop, while the needles that are not made to knit, at said first drop and at said third drop, pass with their beak below the sinkers, retaining in their beak the last loop of knitting formed at the previous drop in order to knit it in with a new loop at the next drop.

* * * * *